US008246474B2

(12) United States Patent
Krollmann et al.

(10) Patent No.: US 8,246,474 B2
(45) Date of Patent: Aug. 21, 2012

(54) KELLY BAR ARRANGEMENT

(75) Inventors: Karl Johannes Krollmann, Augsburg (DE); Melchior Jais, Aresing (DE)

(73) Assignee: Bauer Maschinen GmbH (DE)

( * ) Notice: Subject to any disclaimer, the term of this patent is extended or adjusted under 35 U.S.C. 154(b) by 198 days.

(21) Appl. No.: 12/763,669

(22) Filed: Apr. 20, 2010

(65) Prior Publication Data

US 2011/0105235 A1 May 5, 2011

(30) Foreign Application Priority Data

Apr. 24, 2009 (EP) ..... 09005752

(51) Int. Cl.
*F16D 3/06* (2006.01)

(52) U.S. Cl. ..... 464/92; 175/195

(58) Field of Classification Search ..... 464/20, 464/87, 91, 92, 96, 162–165, 169; 175/195; 92/34, 42
See application file for complete search history.

(56) References Cited

U.S. PATENT DOCUMENTS

| | | | | |
|---|---|---|---|---|
| 2,587,105 | A * | 2/1952 | Bronzan | 464/20 |
| 3,526,284 | A * | 9/1970 | Burge | 464/20 |
| 3,750,423 | A * | 8/1973 | Williams | 464/20 |
| 3,802,322 | A * | 4/1974 | Johnson et al. | 92/34 |
| 4,257,245 | A | 3/1981 | Toelke et al. | |
| 4,693,317 | A * | 9/1987 | Edwards et al. | 464/20 |
| 4,777,868 | A * | 10/1988 | Larsson | 92/42 |
| 4,844,181 | A * | 7/1989 | Bassinger | 464/20 |
| 2009/0023502 | A1 * | 1/2009 | Koger | 464/20 |

FOREIGN PATENT DOCUMENTS

| | | | |
|---|---|---|---|
| DE | 87 14 201 | U1 | 3/1988 |
| DE | 40 38 424 | C1 | 4/1992 |
| EP | 0 798 444 | A1 | 10/1997 |
| EP | 1 445 418 | A1 | 8/2004 |
| GB | 1 221 261 | A | 2/1971 |
| JP | H02-256788 | A | 10/1990 |
| JP | H06-185283 | A | 7/1994 |
| JP | 2003-278474 | A | 10/2003 |
| JP | 2004-278170 | A | 10/2004 |

OTHER PUBLICATIONS

Documents considered to be relevant page of the European Search Report for European Application No. EP 09 00 5752.

* cited by examiner

*Primary Examiner* — Gregory Binda
*Assistant Examiner* — Josh Skroupa
(74) *Attorney, Agent, or Firm* — Studebaker & Brackett PC; Donald R. Studebaker

(57) ABSTRACT

A Kelly bar arrangement includes an inner bar and at least one outer bar, whereby the inner bar is arranged with respect to the at least one outer bar in an axially movable but rotationally fixed manner, and a spring means which is arranged in a lower area of the inner bar for cushioning an axial movement of the inner bar with respect to the at least one outer bar. In accordance with the invention provision is made for the spring means to be designed as an elastomer spring.

8 Claims, 5 Drawing Sheets

KELLY BAR ARRANGEMENT

Figure 1:
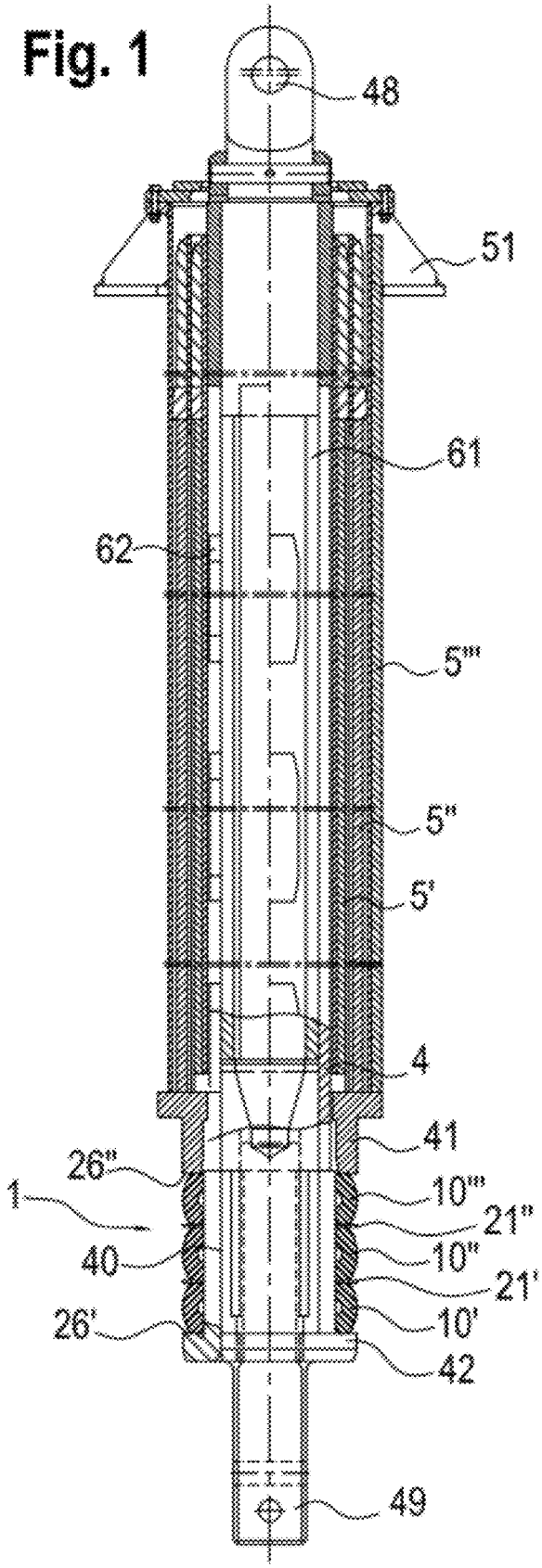

The invention relates to a Kelly bar arrangement in accordance with the preamble of claim 1. A Kelly bar arrangement of such type is designed with an inner bar and at least one outer bar, whereby the inner bar is arranged with respect to the at least one outer bar in an axially movable but rotationally fixed manner, and with a spring means, which is arranged in a lower area of the inner bar for cushioning an axial movement of the inner bar with respect to the at least one outer bar.

Such telescopic Kelly bar arrangements can be employed in so-called Kelly drilling which is one of the most flexible techniques for example for the production of foundation piles for buildings. For this purpose a telescopic drilling rod, the so-called Kelly rod, is arranged on the rotary drive of the drilling device. The Kelly rod consists of several tubular Kelly bars lying inside each other. The innermost Kelly bar is suspended on a rope of the drilling device and can be moved up and down by means of this rope. As a result, the Kelly rod is telescoped. At the bottom of the innermost Kelly bar the drilling tool is fastened. Through vertical strips located on the outer surface of the individual Kelly bar tubes and corresponding vertical drive grooves on the respective adjoining Kelly bar, the torque and therefore the rotary movement is transmitted from one Kelly bar to the Kelly bar adjoining in each case. In this way, the rotary movement is transmitted from the rotary drive to the drilling tool in the drill hole.

In addition to transmitting the rotary movement, so-called "lockable Kelly rods" also allow for the transmission of a vertical force from the rotary drive, which moves up and down via a carriage located on the mast of a drilling device, onto the drilling tool in order to generate the contact pressure required for removing soil. To this end locking pockets are mounted at specific spacings on the individual Kelly bars.

A Kelly rod of this kind is known for instance from EP 1 445 418 A1. A further Kelly rod arrangement is known from JP 2004-278170.

In order to enable the extended Kelly rod to be retracted again a support flange is provided on the inner bar of the Kelly rod. When the inner bar is pulled upwards again by means of the rope of the drilling tool, the bars lying further outwards come to rest on this support flange and are subsequently pulled upwards as well. On the support flange a spring means with a helical spring can be provided in order to cushion the impact of adjoining Kelly bar elements during retraction of the rod. Such spring elements are described for example in EP 0 798 444 A1, JP 2-256788, JP 6-185283 and JP 2003-278474. According to EP 0 798 444 A1, JP 6-185283 and JP 2003-278474 additional damping bodies can be provided above the spring means.

The object of the invention is to provide a Kelly bar arrangement which, whilst being of especially simple construction, can be operated in a specifically reliable manner and, in particular, at low noise level.

The object is solved by a Kelly bar arrangement having the features of claim 1. Preferred embodiments are stated in the dependent claims.

The Kelly bar arrangement in accordance with the invention is characterized in that the spring means being designed as an elastomer spring.

A fundamental idea of the invention can be seen in the fact that instead of a known helical spring an elastomer spring is provided at the lower end of the inner bar. Such an elastomer spring, which can also be referred to as a rubber spring, typically has a body made of elastomer material, as for example natural or synthetic rubber. Due to the internal friction of the elastomer material such elastomer springs have a damping effect in addition to the spring effect. As a result of this damping effect it is possible by way of the spring means in accordance with the invention for impacts occurring on the inner bar not only to be cushioned but also absorbed at least in part. Any undesirable vibrations occurring on the Kelly bars can thus be prevented and the load acting on the Kelly bar arrangement can be reduced. In addition, with an elastomer spring an especially good noise damping can be attained, too. Due to the fact that according to the invention the spring means assumes a double function by serving not only as a spring element but also as a damping element, any additional damping elements, which, according to the prior art, are provided in addition to the spring means, can be dispensed with according to the invention. However, if the damping is to be improved further it is generally possible in accordance with the invention that such additional damping elements are provided, too.

According to the invention the inner bar, which can also be referred to as the inner Kelly, is arranged at least in some areas radially inside the outer bar so that a telescopic arrangement is present. For especially great drilling depths provision can also be made according to the invention for several outer bars arranged telescopically inside each other. Advantageously, the individual bars are arranged coaxially. As far as mention is made in connection with the invention of the axial direction and the radial direction this refers, in particular, to the longitudinal axes of the individual bars.

To ensure the axially movable and rotationally fixed arrangement of the bars with respect to one another drive strips and/or drive grooves can be provided on the bars that ensure torque transmission accompanied by the capability of axial displacement. This is particularly advantageous in the case of a circular bar cross-section. In principle, the rotationally fixed but axially movable arrangement can also be ensured e.g. by a polygonal, more particularly by a square bar cross-section. In order to be able to accommodate the bars lying further inwards it is of advantage for the at least one outer bar to have a hollow, i.e. a tubular design. For weight saving reasons the inner bar suitably has a tubular design, too. However, for particularly good force take-up it can also be solid at least in some areas.

The lower area on which the spring means is arranged can be understood in particular as an area on which the inner bar protrudes from the at least one outer bar and/or on which a fastening means for a drilling tool is arranged, i.e. the area that lies at the bottom during drilling operation with a vertical Kelly bar arrangement.

It is especially preferred that the elastomer spring has several elastomer spring elements. According to this aspect of the invention the elastomer spring consists of several separate elastomer spring elements. As a result, a particularly load-resistant elastomer spring can be obtained in an especially simple way which is, in particular, specifically adapted to the requirements of the respective Kelly bar arrangement.

Furthermore, it is preferred that the elastomer spring elements are arranged axially in series. According to this embodiment an assembly of elastomer spring elements can be provided which are arranged on top of one another along the longitudinal axis of the Kelly bars. By the serial arrangement an especially good damping can be attained, since the damping effect is multiplied as a result of the serial arrangement.

It is especially useful for the elastomer spring elements to have a ring-shaped design. This makes it possible for the elastomer spring elements to be slid onto the inner bar in a particularly easy way. By preference, the ring-shaped elastomer spring elements are arranged on the outer surface of the inner bar, preferably coaxially to the inner bar.

Moreover, it is preferred that the ring-shaped elastomer spring elements have an outward curved arc shape. In particular, the arc shape protruding in the radial direction can already be provided in the unloaded state of the spring element so that on load application a directed spring compression with a widening of the arc shape can take place. On the inner side of the ring of the elastomer spring elements a groove can be formed in the elastomer spring element on a level with the arc shape.

Another preferred embodiment of the invention resides in the fact that at least two elastomer spring elements are provided that are connected to each other via an intermediate bearing ring. Such an intermediate bearing ring can prevent friction between the elastomer spring elements and thus undesirable abrasion of the elastomer spring elements. To keep the work involved in production particularly low it is of advantage for the intermediate bearing ring to have a plate-shaped design. By preference, three or more elastomer spring elements are provided, with adjoining elastomer spring elements being connected to each other via an intermediate bearing ring of their own.

According to the invention it is advantageous that the intermediate bearing ring has axially protruding connection elements which penetrate the adjoining elastomer spring element. These connection elements can be designed as knobs for example. By way of such connection elements that penetrate the elastomer it is possible to effect in an advantageous manner a mutual guidance of the individual elastomer spring elements, which can also be referred to as elastomer buffers.

Advantageously, the at least one intermediate bearing ring is made of metal, in particular of steel. As a result, an especially high load-bearing capacity is given.

With regard to the work involved in production and the load-bearing capacity it is furthermore advantageous for the protruding connection elements to be designed in one piece on the intermediate bearing ring, in particular through metal forming. For example the connection elements can be formed as beaded or deep-drawn knobs on the steel plates.

An arrangement which is both particularly simple from a constructional viewpoint and especially reliable is given in that a ring-shaped bearing collar is provided in an axially fixed manner on the inner bar, in that a ring-shaped support flange is provided for the at least one outer bar, which is axially adjustable relative to the inner bar and supported axially above the bearing collar, in particular on the inner bar, and in that the spring means designed as an elastomer spring is arranged between the axially fixed bearing collar and the axially adjustable support flange. The axially adjustable support flange can serve as a driver which, when the inner bar is pulled upwards, takes along at least the adjoining outer bar and thus brings about a telescopic retraction of the Kelly bar arrangement. In addition, the support flange can also form a stop for the outermost outer bar, which secures the inner bar on the outermost outer bar when the Kelly bar is retracted. The spring means, which is arranged between the ring-shaped support flange and the bearing collar, cushions the impact between the support flange and inner bar and therefore the impact between outer bar and inner bar. Due to the fact that according to the embodiment the elastomer spring is arranged axially between the support flange and bearing collar, the elastomer parts are protected by the support flange against contact with the at least one outer bar, whereby undesirable abrasion is counteracted.

In addition, it is of advantage in accordance with the invention that at the lower end of the inner bar a fastening means for a tool, in particular a drilling tool, is arranged. The fastening means can have e.g. an external polygonal profile, in particular an external square, for example a so-called Kelly square.

To enable lifting of the inner bar and therefore inward telescoping of the Kelly bar arrangement in a particularly easy way it is furthermore preferred that at the upper end of the inner bar a fastening means for a hoisting means, in particular a rope, is arranged. The fastening means can have an eye for example.

For an especially easy torque transmission it is furthermore advantageous that at the upper end of the radially external outer bar a fastening means for a drill drive is arranged.

Especially with regard to the damping properties it is of advantage that the elastomer spring elements are formed of an elastomer material with high internal friction, in particular a rubber mixture.

Figure 3:
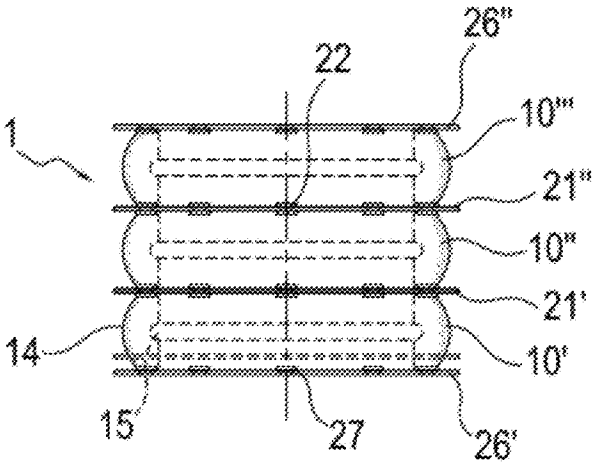
Figure 4:
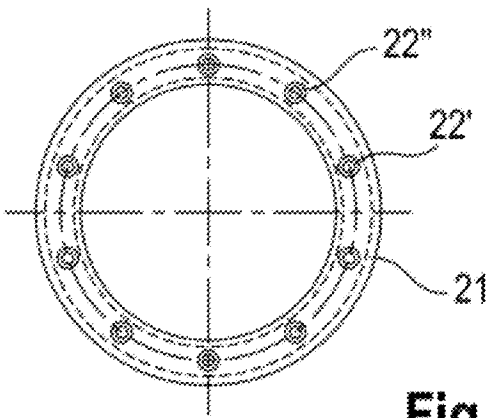
Figure 2:
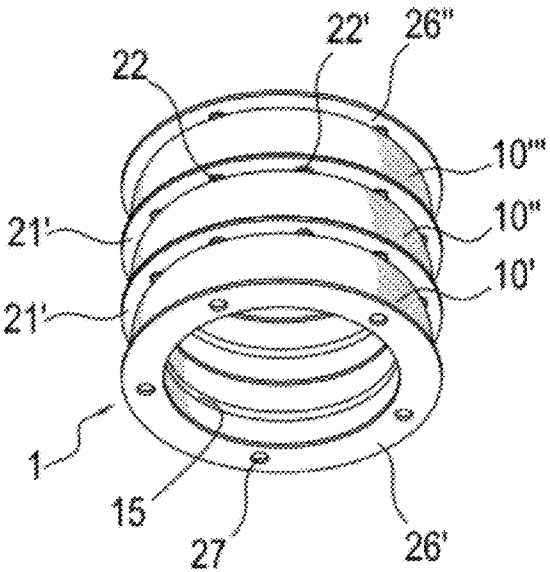
Figure 5:
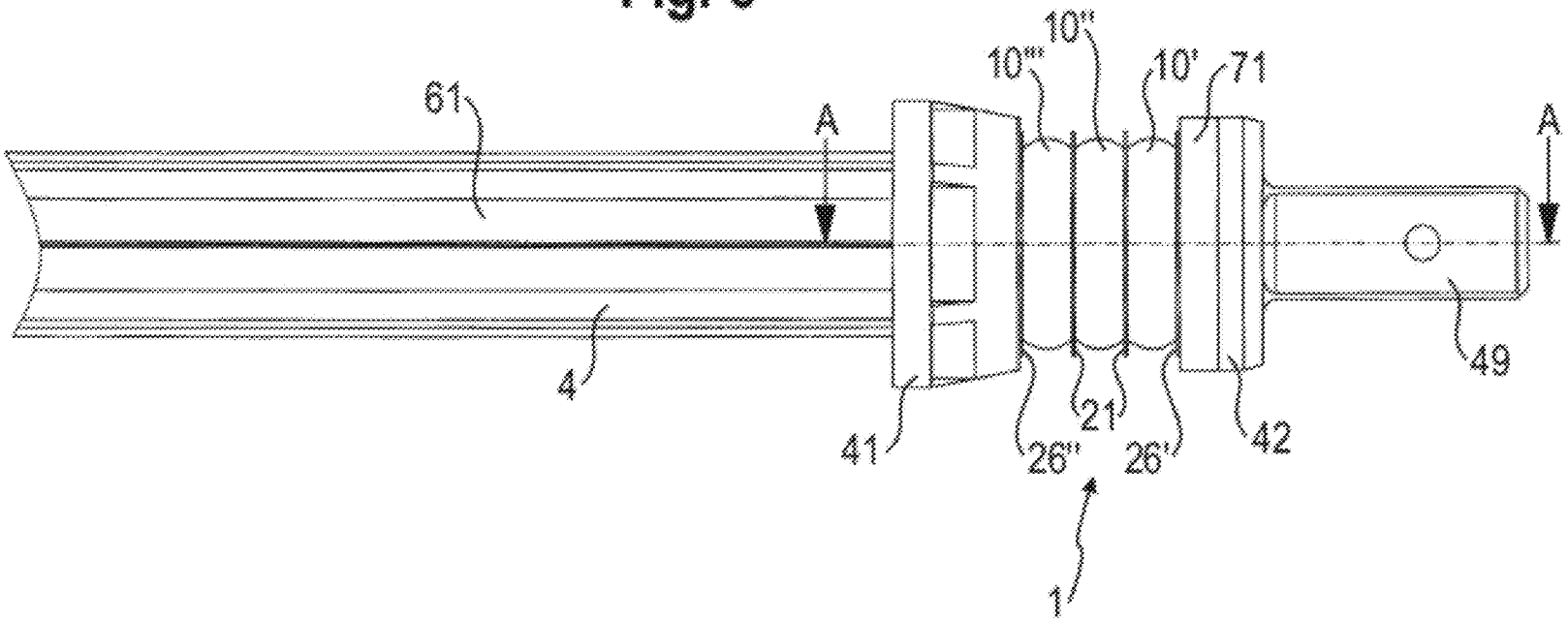
Figure 6:
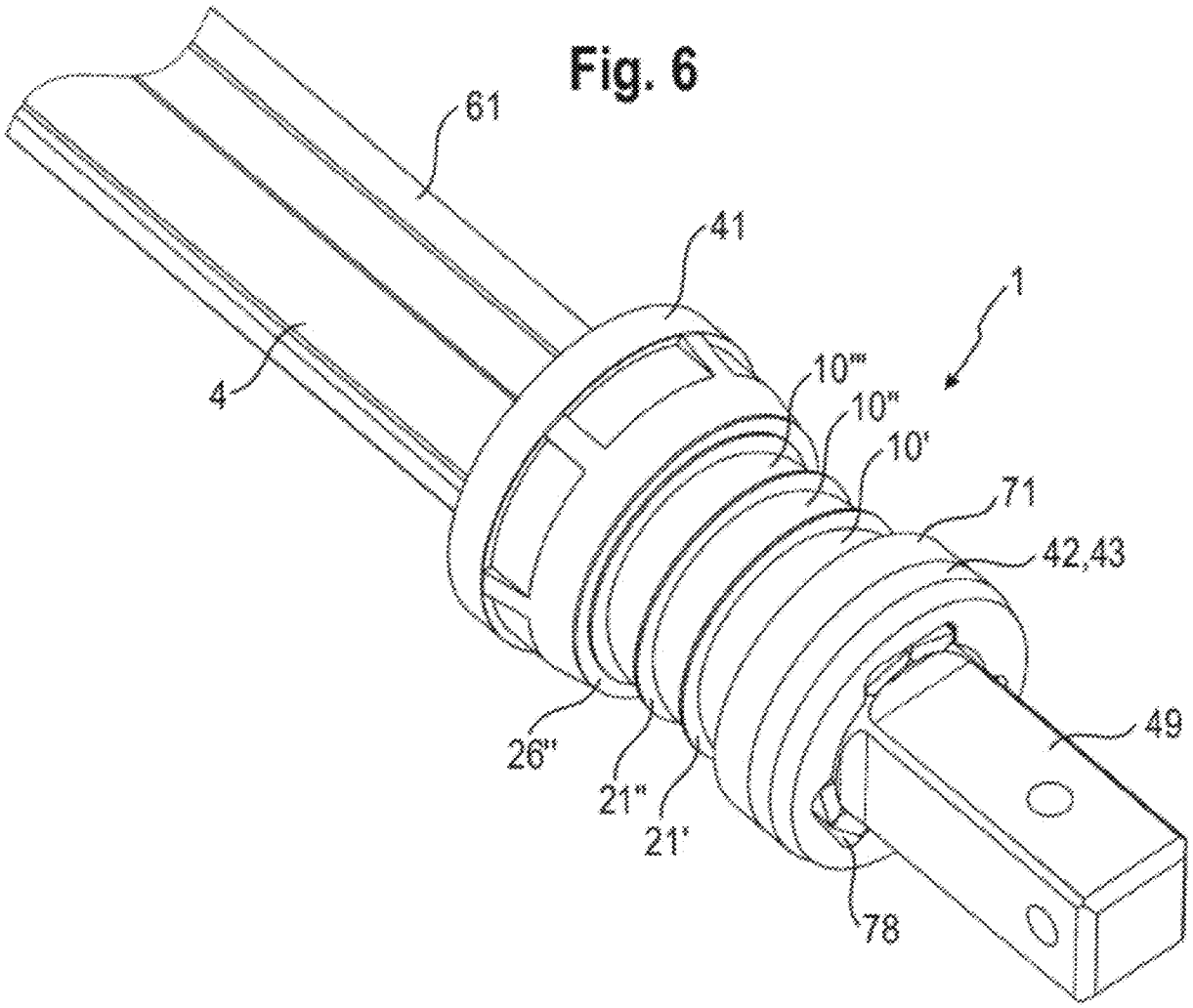
Figure 7:
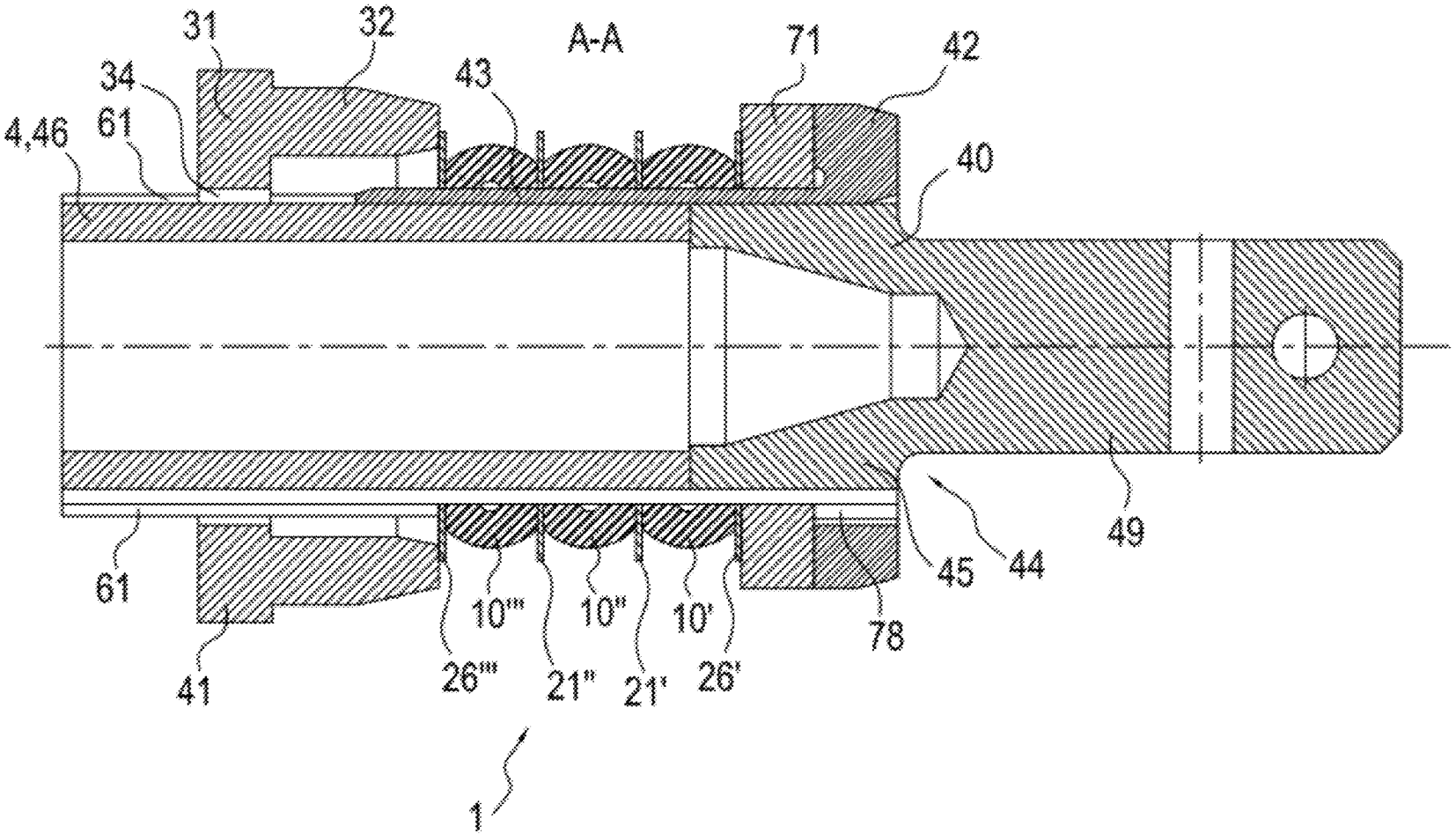

In the following the invention will be explained in greater detail by way of preferred embodiments illustrated schematically in the accompanying Figures, wherein show:

FIG. 1 a longitudinal sectional view along the longitudinal axis of the Kelly bars of a Kelly bar arrangement with spring means in accordance with the invention;

FIG. 2 a perspective detailed view of the spring means of FIG. 1;

FIG. 3 a detailed longitudinal sectional view of the spring means of FIG. 1;

FIG. 4 a top view of an intermediate bearing ring of the spring means of FIGS. 1 to 3;

FIG. 5 the lower area of the inner bar with the spring means of a further embodiment of a Kelly bar arrangement according to the invention in side view;

FIG. 6 the lower area of the inner bar according to FIG. 5 in perspective view; and FIG. 7 the lower area of the inner bar of FIGS. 5 and 6 in longitudinal sectional view.

An embodiment of a Kelly bar arrangement in accordance with the invention is shown in FIG. 1. The Kelly bar arrangement has three tubular outer bars 5', 5" and 5'" as well as a further tubular inner bar 4. The individual bars 4 and 5' to 5'" are arranged coaxially, inside one another and in a telescopic manner. In this, the outer bar 5'" constitutes the radially outermost lying bar. Inside this outer bar 5'" the outer bar 5" is provided in an adjoining manner and in the latter the outer bar 5' is in turn arranged in an adjoining manner. Finally, inside the outer bar 5' the inner bar 4 is provided in an adjoining fashion.

For the torque transmission between the individual bars 4 and 5, which are designed with a circular cross-section, drive strips 61, shown schematically only, are provided that extend on the individual bars 4 and/or 5 in the axial direction. For the transmission of axial forces, i.e. for the temporary axial locking of the individual bars 4 and 5, locking pockets 62, shown schematically only, are provided at different levels when seen in the axial direction.

At the upper end of the outermost outer bar 5'", as seen in the axial direction, a fastening means 51 for a drill drive, not depicted in the Figures, is provided on the outermost outer bar 5'". This fastening means has a flange-shaped design so as to prevent the outermost outer bar 5'" from slipping through the hollow shaft of the drill drive. In the area of the fastening means 51 on the outermost outer bar 5'" means for a form-locking torque transmission from the drill drive to the outer bar 5'" can also be provided.

In a lower area, when seen in the axial direction, the inner bar 4 has an extension 40 which protrudes downwards from the outer bars 5', 5" and 5'" even in the retracted state. The extension 40 can also be tubular or even have a solid design. At the lower end of the extension 40 of the inner bar 4 a fastening means 49 for a drilling tool, not shown in the Figures, is arranged, in which case this fastening means 49 is designed as an external square profile with a retaining hole. At the upper end of the inner bar 4 lying opposite in the axial direction a fastening means 48 for a hoisting rope having an eye is provided on the inner bar 4.

The inner bar 4 has at its lower end, i.e. on its extension 40, a ring-shaped bearing collar 42 that protrudes radially from the inner bar 4. Above this bearing collar a support flange 41 is provided which surrounds the inner bar 4 in an annular fashion. This support flange 41 constitutes a stop for the outer bars 5', 5" and 5'". While the bearing collar 42 is provided in an axially fixed manner on the inner bar 4, the support flange 41 is supported on the inner bar 4 in an axially movable manner relative to the inner bar 4. Between the support flange 41 and the bearing collar 42 a spring means 1 according to the invention is provided that surrounds the inner bar 4 in an annular fashion. By means of this spring means 1, which is explained below in greater detail in conjunction with FIGS. 2 to 4, the movable support flange 41 is cushioned relative to the stationary bearing collar 42.

During operation of the Kelly bar arrangement a torque is applied via a drill drive, not depicted here, in the area of the fastening means 51 onto the outermost lying outer bar 5'". The torque is passed on successively via the drive strips 61 to the further inward lying outer bars 5" and 5' and finally to the inner bar 4 which, in turn, transmits the torque via the fastening means 49 to the drilling tool not shown here. If the Kelly bar arrangement is to be extended in the axial direction, the inner bar 4 is lowered by lowering the hoisting rope which is fastened on the fastening means 48. By doing so, the individual bars 4, 5 are extended successively in a telescopic manner.

For retraction of the Kelly bar arrangement the inner bar 4 is lifted by the hoisting rope on the fastening means 48. In doing so, the support flange 41 on the inner bar 4 comes to rest successively first against the lower end of outer bar 5' and then against that of outer bar 5" and thereby takes along these outer bars 5' and 5" in the upward direction. The retraction process is completed as soon as the support flange 41 comes to rest against the lower end of the outermost outer bar 5'".

The moment the support flange 41 of the inner bar 4 comes to rest against the outer bars 5', 5" or 5'" axial downward directed impact forces occur in the support flange 41. These forces are cushioned via the spring means 1 with respect to the bearing collar 42 and therefore the inner bar 4.

As shown in FIGS. 2 to 4 in particular, the ring-shaped spring means 1 of the inner bar 4 is designed as an elastomer spring. In the illustrated embodiment it has three separate elastomer spring elements 10', 10", 10'", which are arranged as a spring assembly on top of each other in the axial direction. As depicted in FIG. 3 in particular, the individual elastomer spring elements 10', 10", 10'" are each of the same shape and, by preference, also of the same material. As illustrated in FIG. 3 in the example of the elastomer spring element 10' in particular, the elastomer spring elements 10 have a ring-shaped design, and on the outer surface a ring-shaped bulge is provided in the radial outward direction, which forms an arc shape 14 in longitudinal section. On the opposite situated inner side of the ring of the elastomer spring element 10 an annular groove 15 is provided on a level with the arc shape 14. Hence, the elastomer spring elements 10 have a radially outward directed arching which is able to expand radially outwards during compression of the spring means 1.

As shown in FIGS. 1, 2 and 3 in particular, the individual elastomer spring elements 10 are separated in the axial direction by plate-shaped intermediate bearing rings 21 that surround the inner bar 4 in a ring-shaped manner. Between the elastomer spring elements 10' and 10" a first intermediate bearing ring 21' and between the elastomer spring elements 10" and 10'" a second intermediate bearing ring 21" is provided, in which case the intermediate bearing rings 21' and 21" are substantially of identical design.

At the opposite ends of the spring means 1, i.e. at the bottom on the lowermost elastomer spring element 10' and at the top on the uppermost elastomer spring element 10'", an end bearing ring 26' and 26" is provided respectively. Via the end bearing ring 26' the spring means 1 rests against the bearing collar 42 and via the end bearing ring 26" it rests against the support flange 41.

As depicted in FIG. 4 in particular but also in FIGS. 2 and 3, the intermediate bearing rings 21 each have several knob-shaped connection elements 22 that protrude axially from the intermediate bearing ring 21. These connection elements 22 are preferably designed in one piece with the intermediate bearing ring 21 and can be shaped e.g. through beading or drawing, which, where appropriate, takes place after the introduction of appropriate holes. The connection elements 22 engage into adjoining elastomer spring elements 10 and fix these adjoining elastomer spring elements 10 relative to the intermediate bearing ring 21. As illustrated in FIG. 4 in particular, along the circumference of the intermediate bearing rings 21 upward protruding connection elements 22' and downward protruding connection elements 22" are provided in alternating fashion that engage into the next upper and the next lower elastomer spring element 10, respectively.

As shown in FIGS. 2 and 3 in particular, the end bearing rings 26 also have connection elements 27 which protrude axially from the end bearing rings 26 and are designed in analogy to connection elements 22. Due to the fact that, in contrast to the intermediate bearing rings 21, on the end bearing rings 26 elastomer spring elements 10 are not provided on both axial sides but on one side only, connection elements 27 only need to be provided on one axial side in the case of the end bearing rings 26, whereas in the case of the intermediate bearing rings 21 connection elements 22', 22" are required on both opposite axial sides. Accordingly, in the case of the end bearing rings 26 fewer connection elements 27 are provided in total as in the case of the intermediate bearing rings 21.

During operation of the spring means axial forces are introduced via the end bearing rings 26 onto the elastomer spring elements 10. These axial forces, which arise when the inner bar 4 strikes with its support flange 41 against the outer bars 5, are not only cushioned but also damped by the elastomer spring elements 10. The intermediate bearing rings 21, which separate the individual elastomer spring elements 10 from one another, prevent friction between the individual elastomer spring elements 10 and therefore undesirable abrasion. At the same time the connection elements 22 and 27 ensure that the individual elastomer spring elements 10 and the rings 21 and 26 remain in a defined position with respect to each other. During spring compression the individual elastomer spring elements 10 are compressed in the axial direction. This is accompanied by a radial expansion that manifests itself in a radial widening of the arc shape 14.

A further embodiment of a Kelly bar arrangement according to the invention is shown in FIGS. 5 to 7. For the sake of clarity only the lower area of the inner bar 4 is shown in these Figures, while the outer bars were omitted. These can be arranged in analogy to the embodiment of FIG. 1. The spring element 1 employed in the embodiment of FIGS. 5 to 7 corresponds to spring element 1 of FIGS. 1 to 4, for which reason it is not explained in detail again.

Elements having the same effect as in the previous embodiment are designated with the same reference signs in FIGS. 5 to 7.

As illustrated in FIG. 7 in particular, in the embodiment of FIGS. 5 to 7 the inner bar 4 has an upper tube 46 and a partly solid extension 40 that follows on from the upper tube 46. In a connecting area 45 to the upper tube 46 the extension 40 is designed with the same diameter as the upper tube 46 and has an internal bore. At the opposite end of the extension 40 the fastening means 49 for the drilling tool is provided, on which the extension 40 is solid. Between the connecting area 45 and the fastening means 49 a ring-shaped step 44 is formed, on which the extension 40 tapers towards the fastening means 49.

As furthermore shown in FIG. 7, according to the embodiment of FIGS. 5 to 7 the bearing collar 42 is arranged at the lower end of a sleeve 43 that surrounds the inner bar 4. In particular, the sleeve 43 extends both in the area of the extension 40 and in the area of the upper tube 46. In this, the bearing collar 42 is arranged such that it is aligned with step 44 of extension 40. The spring means 1 with the elastomer spring elements 10 is slid onto the sleeve 43, i.e. the spring means 1 with the elastomer spring elements 10 is located on a level with the sleeve 43 when seen in the axial direction.

Between the spring means 1 and the bearing collar 42, i.e. above the bearing collar 42, a spacing ring 71 is arranged according to the embodiment of FIGS. 5 to 7 which, on account of its position, also surrounds the sleeve 43. On this spacing ring 71 the spring means 1 rests with the end bearing ring 26'. The spacing ring 71 can be made of metal, as for example steel. However, to further improve the damping properties the spacing ring 71 can basically also be made of a damping material, for example an elastomer material. Advantageously, the spacing ring 71 is designed in the shape of a cylindrical ring.

As furthermore shown in FIG. 7 in particular, the support flange 41 of the embodiment of FIGS. 5 to 7 is offset with respect to the sleeve 43, i.e. it is supported in an axially displaceable manner above the sleeve 43 on the upper tube 46 of the inner bar 4. As depicted in FIG. 7 in particular, the support flange 41 has several functional sections. More particularly, a ring-shaped guide section 31 is provided, in which the support flange 41 rests against the inner bar 4 and in which the support flange 41 is guided on the inner bar 4. The guide section 31 constitutes at the same time the stop for taking along the outer bar not shown in FIGS. 5 to 7. At the underside of the ring-shaped guide section 31 a ring-shaped actuating section 32 is provided. This actuating section 32 is spaced from the inner bar 4. At the actuating section 32 the support flange 41 rests on the spring means 1, especially on the upper end bearing ring 26".

The support flange 41 has grooves 34 that correspond to the drive strips 61 on the inner bar 4. These grooves 61 that extend in the axial direction and are arranged in the guide section 31 ensure form-locking guidance of the support flange 41 on the inner bar 4 and prevent the support flange 41 from twisting on the inner bar 4. For the same reason axially extending grooves can also be provided on the sleeve 43, which correspond with the drive strips 61.

As shown in FIG. 6 in particular, in the bearing collar 42 provision is also made for axially extending grooves 78 that can serve, for instance, for the rotational securing of the fastening means 49.

The invention claimed is:

1. A Kelly bar arrangement comprising:

an inner bar and at least one outer bar, whereby the inner bar is arranged with respect to the at least one outer bar in an axially movable but rotationally fixed manner, and spring means being arranged in a lower area of the inner bar for cushioning an axial movement of the inner bar with respect to the at least one outer bar, wherein the spring means is an elastomer spring, the elastomer spring has several elastomer spring elements, at least two elastomer spring elements are provided which are connected to each other via an intermediate bearing ring, and the intermediate bearing ring has axially protruding connection elements which penetrate the adjoining elastomer spring element.

2. The Kelly bar arrangement according to claim 1, wherein the elastomer spring elements are arranged axially in series.

3. The Kelly bar arrangement according to claim 1, wherein the elastomer spring elements have a ring-shaped design with an outward curved arc shape.

4. The Kelly bar arrangement according to claim 1, wherein the intermediate bearing ring is made of metal and the protruding connection elements are designed in one piece on the intermediate bearing ring through metal forming.

5. The Kelly bar arrangement according to claim 1, wherein a ring-shaped bearing collar is provided in an axially fixed manner on the inner bar, a ring-shaped support flange is provided for the at least one outer bar, which is axially adjustable relative to the inner bar and supported axially above the bearing collar, and the spring means designed as an elastomer spring is arranged between the axially fixed bearing collar and the axially adjustable support flange.

6. The Kelly bar arrangement according to claim 1, wherein at the lower end of the inner bar a fastening means for a tool, in particular a drilling tool, is arranged, and at the upper end of the inner bar a fastening means for a hoisting means, in particular a rope, is arranged.

7. The Kelly bar arrangement according to claim 1, wherein at the upper end of the radially external outer bar fastening means for a drill drive is arranged.

8. The Kelly bar arrangement according to claim 1, wherein the elastomer spring elements are formed of an elastomer material with high internal friction, in particular a rubber mixture.

* * * * *